US005489969A

United States Patent [19]

Soler et al.

[11] Patent Number: 5,489,969

[45] Date of Patent: Feb. 6, 1996

[54] APPARATUS AND METHOD OF CONTROLLING INTERPOSITION OF SHEET IN A STREAM OF IMAGED SUBSTRATES

[75] Inventors: Jose J. Soler; Gary W. Roscoe, both of Fairport; Kenneth P. Moore, Rochester; Donald L. Miller, Penfield; Richard E. Eisemann, Rochester, all of N.Y.

[73] Assignee: Xerox Corporation, Stamford, Conn.

[21] Appl. No.: 411,174

[22] Filed: Mar. 27, 1995

[51] Int. Cl.[6] ..... G03G 15/00

[52] U.S. Cl. ..... 355/207; 355/325; 270/58

[58] Field of Search ..... 355/205–207, 355/316, 325; 270/51, 57, 58; 271/259, 3.14, 258.01; 364/478

[56] References Cited

U.S. PATENT DOCUMENTS

| | | | |
|---|---|---|---|
| 4,248,525 | 2/1981 | Sterrett | 355/14 |
| 4,536,078 | 8/1985 | Ziehm | 355/14 |
| 4,561,772 | 12/1985 | Smith | 355/14 |
| 4,602,776 | 7/1986 | York et al. | 271/4 |
| 4,961,092 | 10/1990 | Rabb et al. | 355/323 |
| 5,095,342 | 3/1992 | Farrell et al. | 355/319 |
| 5,184,185 | 2/1993 | Rasmussen et al. | 355/308 |
| 5,272,511 | 12/1993 | Conrad et al. | 355/325 |
| 5,337,135 | 8/1994 | Malachowski et al. | 355/319 |
| 5,379,128 | 1/1995 | Isbida et al. | 355/316 X |

OTHER PUBLICATIONS

John R. Yonovich, "Dual Function Sheet Feeder", *Xerox Disclosure Journal,* vol. 19, No. 4, Jul./Aug. 1994, pp. 333–335.

*Primary Examiner*—Joan H. Pendegrass
*Attorney, Agent, or Firm*—Gary B. Cohen

[57] ABSTRACT

A technique is provided for controlling the interposition of one or more special sheets into a stream of regular imaged substrates. In one example, a point in time at which a special insert sheet should be fed from a special insertion sheet subsystem to the stream is determined by reference to plural sets of preset time periods. In this example, the preset time periods can be adjusted to accommodate print engine/interposing module machine clock fluctuations. In another example, interposition of a special insert sheet with the stream of regular imaged substrates is maintained at an acceptable level by comparing a distance between a special insert sheet fed to the stream and an adjacent regular imaged substrate with a predefined tolerance. The comparison can then be used to adjust feed times of special insert sheets subsequently fed to the stream.

19 Claims, 14 Drawing Sheets

APPARATUS AND METHOD OF CONTROLLING INTERPOSITION OF SHEET IN A STREAM OF IMAGED SUBSTRATES

The present invention relates generally to a technique for producing a print job including one or more one imaged regular substrates and at least one special insert sheet and more particularly to an apparatus and method for interposing the at least one special insert sheet into a stream of the one or more imaged regular substrates and controlling the timing associated with the interposing process.

The primary output product of a typical printing machine is a printed substrate, such as a sheet of paper bearing printed information in a specified format. Quite often, customer requirements necessitate that this output product be configured in various specialized arrangements or print sets ranging from stacks of collated loose printed sheets to tabulated and bound booklets. Even when using state of the art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to produce a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

Accordingly, these special insert sheets must be inserted into the stream of sheets subsequent to processing in the printer processor section of the document producing apparatus, It is desirable to insert these sheets without disrupting the flow of the continuous stream of processed sheets. It is also desirable to insert these sheets in a manner which is transparent to the print processor on the finishing apparatus so that the operation of these apparatus need not be modified. The following disclosures relate to the area of inserting one or more insert sheets among a plurality of previously marked sheets:

U.S. Pat. No. 5,272,511

Patentees: Conrad et al.

Issued: Dec. 21, 1993

U.S. Pat. No. 4,961,092

Patentee: Rabb et al.

Issued: Oct. 2, 1990

U.S. Pat. No. 4,602,776

Patentee: York et al.

Issued: Jul. 29, 1986

U.S. Pat. No. 4,561,772

Patentee: Smith

Issued: Dec. 31, 1985

U.S. Pat. No. 4,536,078

Patentee: Ziehm

Issued: Aug. 20, 1985

U.S. Pat. No. 4,248,525

Patentee: Sterret

Issued: Feb. 3, 1981

Xerox Disclosure Journal—Vol. 19, No. 4, pp. 333–336

Patentee: John R. Yonovich

Disclosed: July/August 1994

U.S. Pat. No. 5,272,511 discloses a sheet inserter for inserting one or more special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

U.S. Pat. No. 4,961,092 discloses a preprogrammed post-collation system for a copier which uses plural sorter bins and a recirculating document handler. Preprogrammable pause points in the copying operation allow for repeatedly inserting a variable number of job inserts or other special copy sheets into the bins being filled (by producing copies of these special documents or by manually inserting them into the bins), at any selected document copying point. The copying sequence must be manually restarted after the appropriate insertion operation is completed.

U.S. Pat. No. 4,602,776 discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,536,078 discloses an automatic document handling system for recirculative document duplex copying to provide precollated simplex or duplex copies with proper image orientation on the output copy sheet for copies made on special orientation restricted copy sheets as well as non-orientation sensitive copy sheets. A switching system is provided for selecting between feeding of copy sheets from a main supply tray or a special copy sheet supply tray. A control system is provided for causing the document handling system to circulate the input copy sheets once before copying, to count the input copy sheets and to determine whether an odd or even number of input sheets are being provided to improve operating efficiency.

U.S. Pat. No. 4,561,772 to Smith discloses several approaches for inserting orientation sensitive paper into a copier with a paper path loop and two paper trays disposed adjacent the loop. With the Smith copier, orientation sensitive paper can be loaded into one of the trays for feeding into the loop in accordance with the marking requirements of a copy job. In one example, a system operator informs the controller of the copier of the presence of orientation sensitive paper by activating a switch or button. Accordingly, the copy job is processed, in part, on the basis of the switch being activated.

U.S. Pat. No. 4,248,525 discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the RDH at the appropriate time and cause the appropriate insert sheet to be fed from its corresponding storage bin into the stream of regular sheets output from the copier. Thus, collated complete print sets of a particular document are generated.

The Xerox Disclosure Journal article discloses a dual function sheet feeder including first and second sheet feeding paths which share common initial document path portion, diverting at a gate to provide separate functions. The first sheet feeding path allows input documents to be transported for document imaging and onward to a document restacking tray. The second sheet feeding path allows transport of input documents into a print engine input path to be merged into the regular sheet feeding path for delivery to the finisher.

In various known printing systems, marking software is employed, in conjunction with one or more controllers, to implement a sheet scheduling technique. More particularly, in one known system each page of a job is programmed for printing and the corresponding marking related information is communicated to a print manager node. In turn, the print manager node generates a schedule indicating the sequence in which the sides of the job pages are to be printed. This is a straightforward process, provided each page is to be printed in simplex. If, however, selected ones of the pages are to be printed in duplex with a multipass approach, then the schedule must reflect the order in which the various sides of the pages are to be imaged. Pursuant to generating a schedule, the print manager node passes the schedule along to various other nodes, such as a marking node and a paper handling node, to coordinate operation of the printing system during the imaging process. When an inserter is used in conjunction with a print engine, the schedule generated by the print manager will, by necessity, include information regarding the times at which insertion sheets are to be fed into a stream of imaged sheets exiting the print engine. The following patents relate to the area of sheet scheduling:

U.S. Pat. No. 5,095,342

Patentees: Farrell et al.

Issued: Mar. 10, 1992

U.S. Pat. No. 5,184,185

Patentees: Rasmussen et al.

Issued: Feb. 2, 1993

U.S. Pat. No. 5,337,135

Patentees: Malachowski et al.

Issued: Aug. 9, 1994

U.S. Pat. No. 5,095,342 discloses a printing system with an endless duplex loop in which copy sheets to be imaged are inserted consecutively into the duplex loop without placing any skipped pitches therebetween regardless of set or job boundaries. Duplex side ones from subsequent sets or jobs are used to fill any gaps which exist in the duplex side one sheet stream of earlier sets or jobs.

U.S. Pat. No. 5,184,185 discloses a printing system wherein gaps, which naturally exist in the output of printed copy sheets from a duplex paper path due to duplex printing, are selectively combined with interset interval skipped pitches so as to provide an appropriate interset interval between each set of printed copy sheets output from a printer, while minimizing the number of skipped pitches which actually need to be scheduled.

U.S. Pat. No. 5,337,135 discloses a trayless duplex printer with a variable path velocity. The printer includes a paper path loop with plural drives driven by a variable speed drive. Through use of the variable speed drive, interleaving spaces can be generated between duplexing path sheets. Conversely, the variable speed drive can be operated so as to close up interleaving spaces.

All references cited in the present specification and their references are incorporated herein by reference where appropriate for appropriate teachings of additional or alternative details, features and/or technical background.

In U.S. Pat. Nos. 4,561,772 and 4,536,078 some sort of technique is inevitably required to determine when a special insert sheet is to be fed to a stream of imaged substrates so that the special insert sheet is interposed into the stream at a desired location. In one embodiment, this technique could include scheduling a special insert sheet feed upon determining the presence of a noticable gap in the stream. This approach would not, however, be suitable for scheduling a special insert sheet feed when interposition of the special insert sheet is to be made in a special sheet insert system which is separate from the print engine. It would be desirable to provide a technique for special insert sheet feeding which accommodates for the constraints of a printing system with an interposer module coupled to a print engine.

In accordance with one aspect of the present invention there is provided an interposer and control apparatus intended for use with a printing system for producing a print job, the printing system including a print engine for imaging regular substrates, fed to the print engine from a regular substrate feeding apparatus, and delivering the imaged regular substrates as an output. The interposer and control apparatus includes: a) a special sheet insertion system operatively coupled with said print engine, said special sheet insertion system including, i) a special sheet insertion subsystem for holding and feeding special insert sheets, ii) a special sheet insertion path passing by said special sheet insertion subsystem, the special insert sheets being feedable to the special sheet insertion path and interposed into the delivered output of imaged regular substrates; b) a processor, communicating with the print engine and said special insert sheet insertion system, said processor, i) setting a first set of one or more time periods associated with moving one of the imaged regular substrates from a source point associated with the print engine to a point adjacent the special sheet insertion system, ii) setting a second set of time periods associated with moving both the one of the imaged regular substrates and one of the special insert sheets in said special sheet insertion system, and iii) determining a point in time at which the one of the special insert sheets is to be fed from said special sheet insertion subsystem to said special sheet insertion path by reference to the first and second sets; and c) said special sheet insertion subsystem feeding the one of the special insert sheets to said special sheet insertion path at a point in time in accordance with said determined point in time.

In accordance with another aspect of the present invention there is provided an interposer and control apparatus intended for use with a printing system for producing a print job, the printing system including a print engine for imaging regular substrates, fed to the print engine from a regular substrate feeding apparatus, and delivering the imaged regular substrates as an output, the delivered output including a series of spaces. The interposer and control apparatus including: a) a special sheet insertion system operatively coupled with said print engine, said special insert sheet insertion system including, i) a special sheet insertion subsystem for holding and feeding special insert sheets, the special insert sheets including a first special insert sheet and a second special insert sheet, the first special insert sheet being scheduled to be fed from said special insertion subsystem at a first scheduled point in time and the second special insert sheet being scheduled to be fed from said special insertion subsystem at a second scheduled point in time, ii) a special sheet insertion path passing by said special sheet insertion subsystem, the special insert sheets being feedable to the special sheet insertion path and interposable with the delivered output of imaged regular substrates; b) said special sheet insertion subsystem feeding the first special insert sheet to the special sheet insertion path, at the first scheduled point in time, so that the first special insert sheet is disposed in one of the series of spaces to form a gap between one of the imaged regular substrates and the first special insert sheet, the having a magnitude associated therewith; c) a controller for determining whether the magnitude associated with the gap is within of a predefined tolerance; and d) when the magnitude associated with the gap is outside of the predefined tolerance, said controller rescheduling the second scheduled point in time.

These and other aspects of the invention will become apparent from the following description, the description being used to illustrate a preferred embodiment of the invention when read in conjunction with the accompanying drawings.

Figure 1:
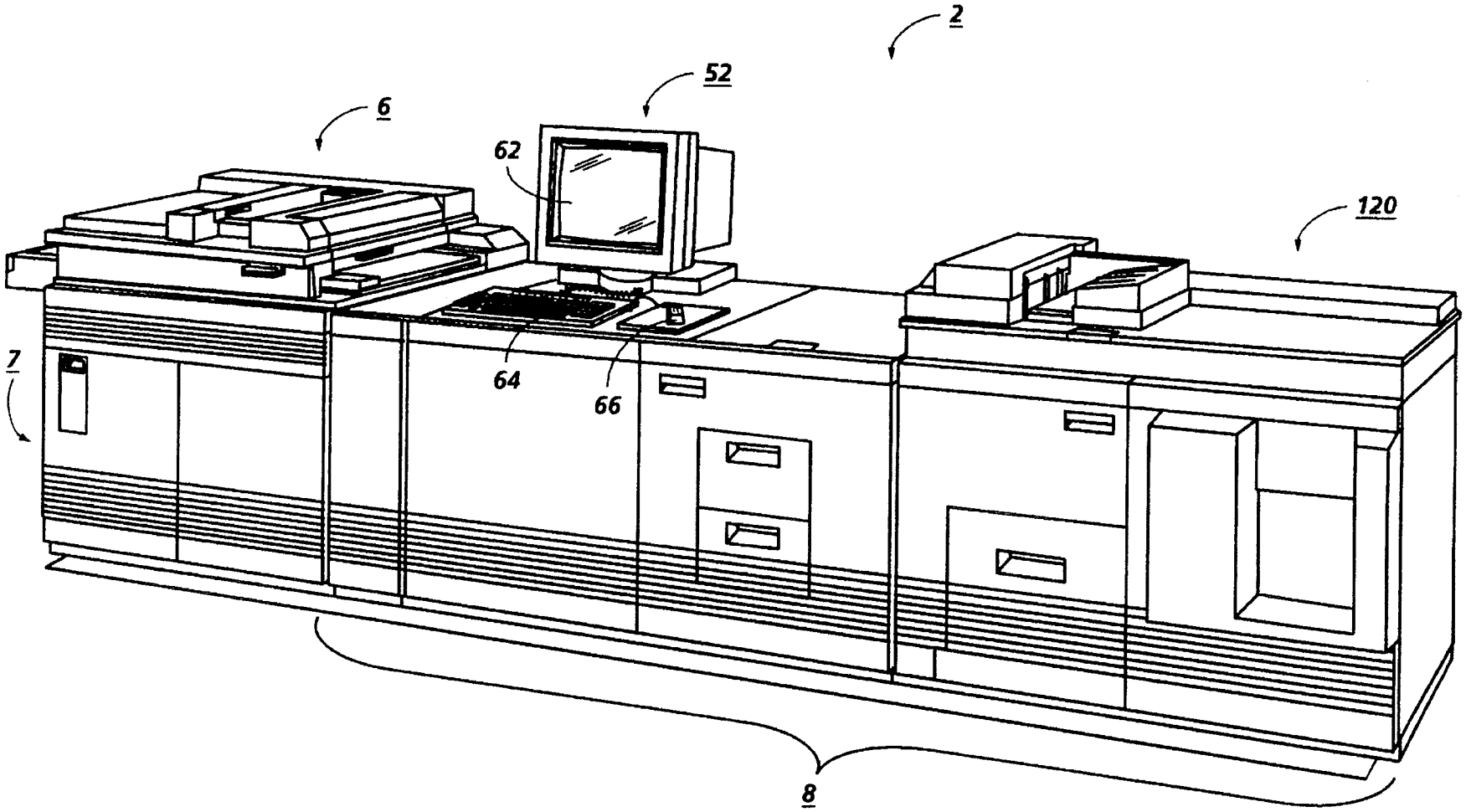
FIG. 1 is a perspective view depicting an electronic printing system.
Figure 3:
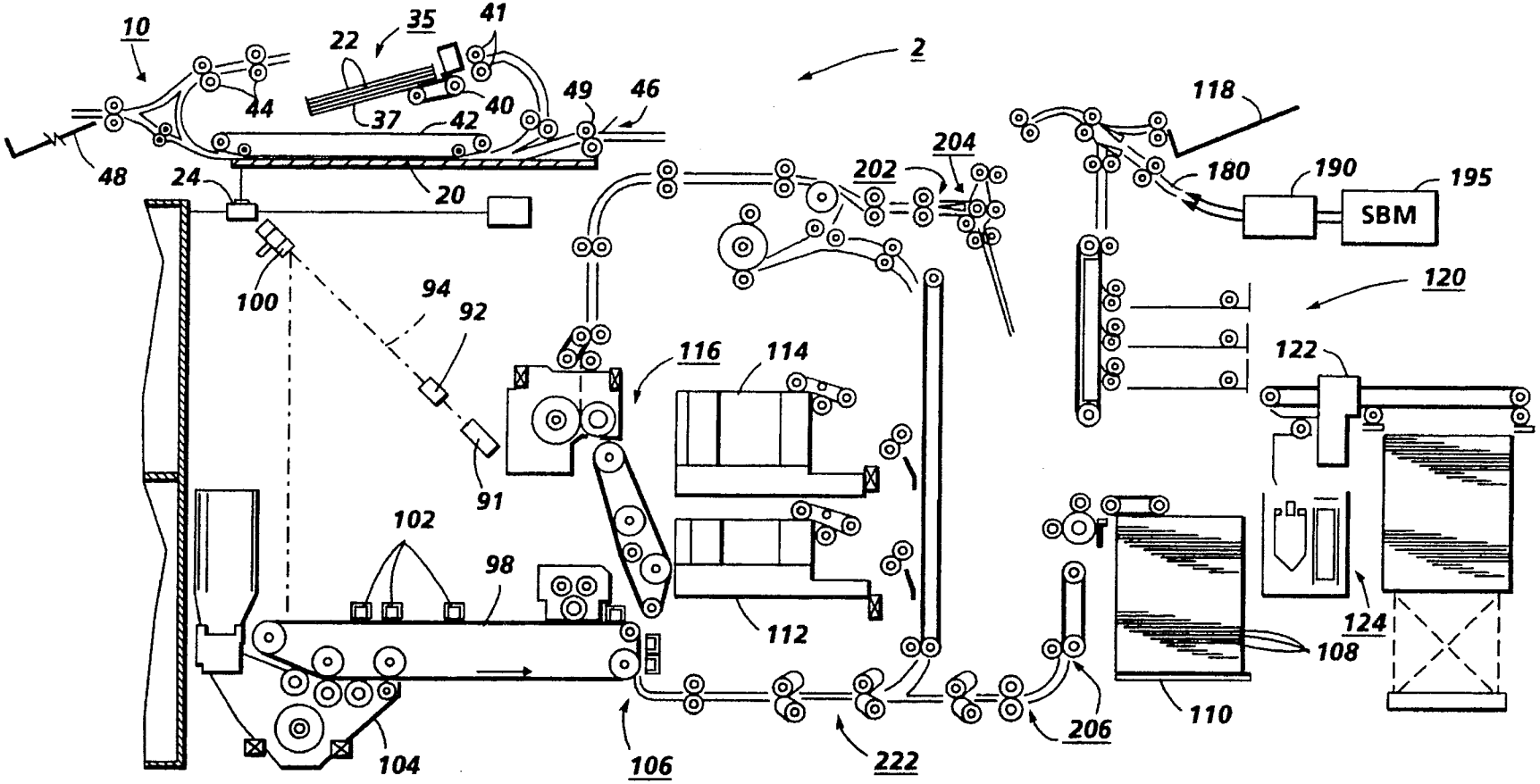
FIG. 3 is an elevational view illustrating the principal mechanical components of the printing system shown in FIG. 1.
Figure 5:
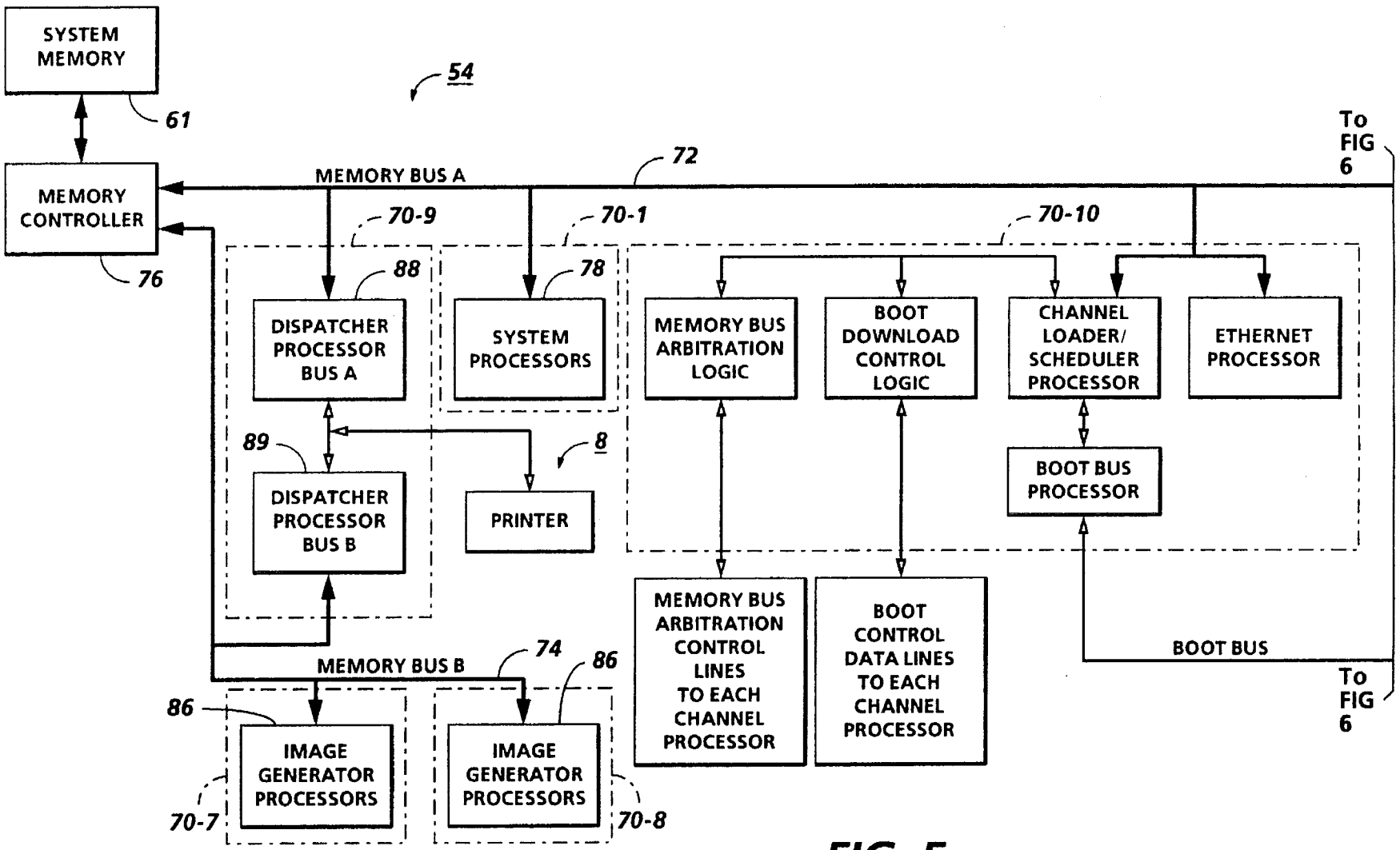
Figure 6:
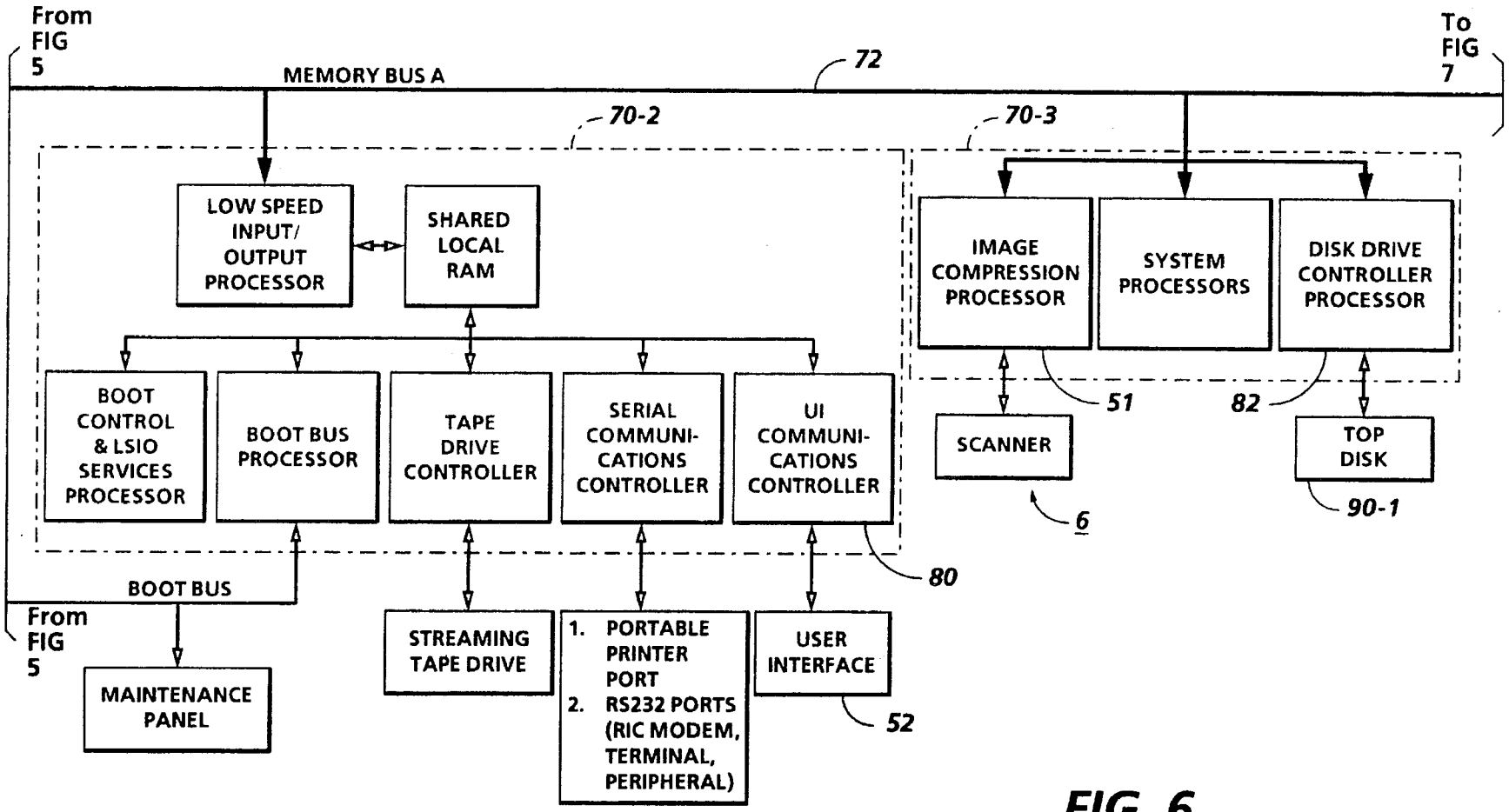
Figure 7:
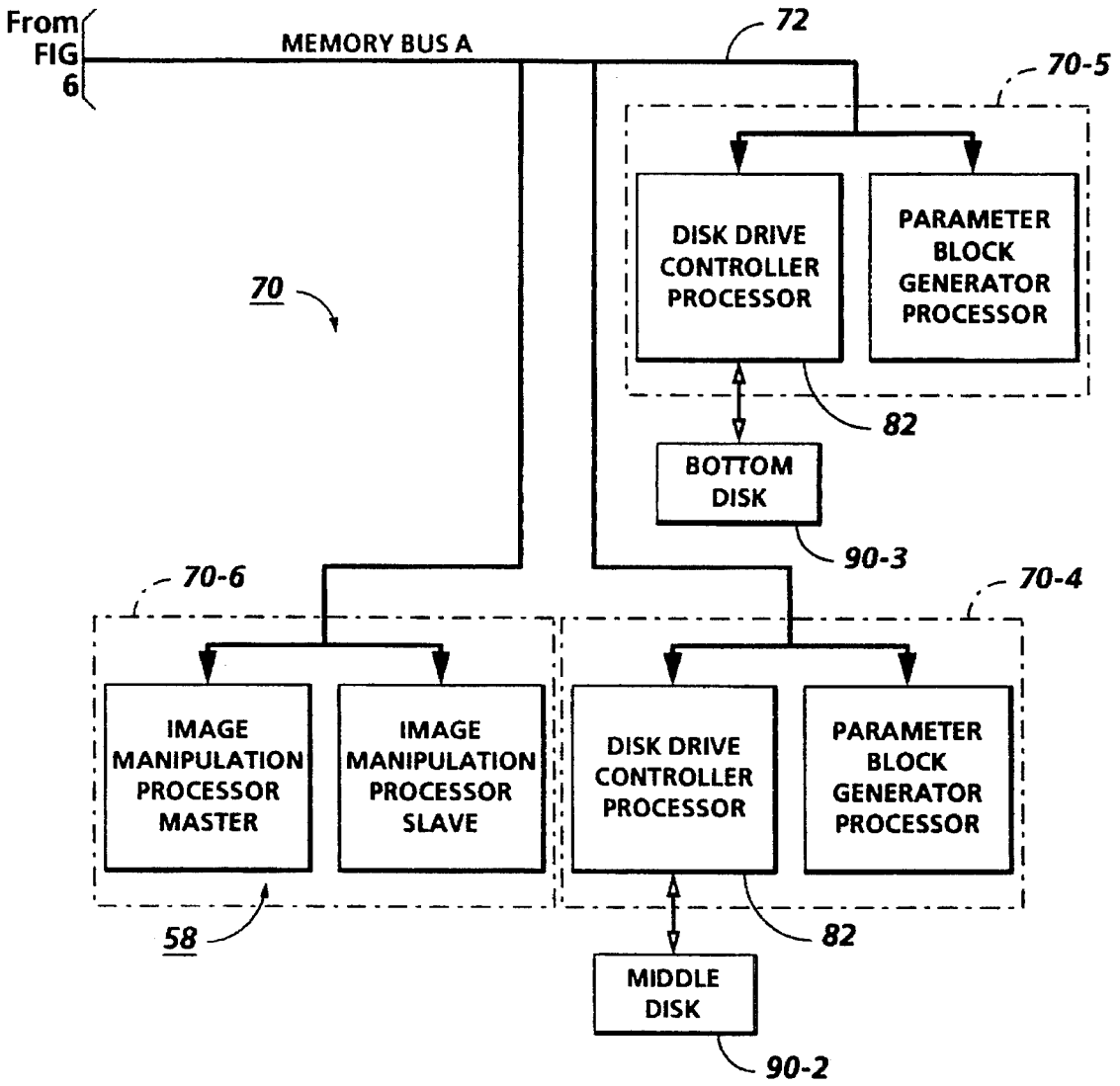
Figure 8:
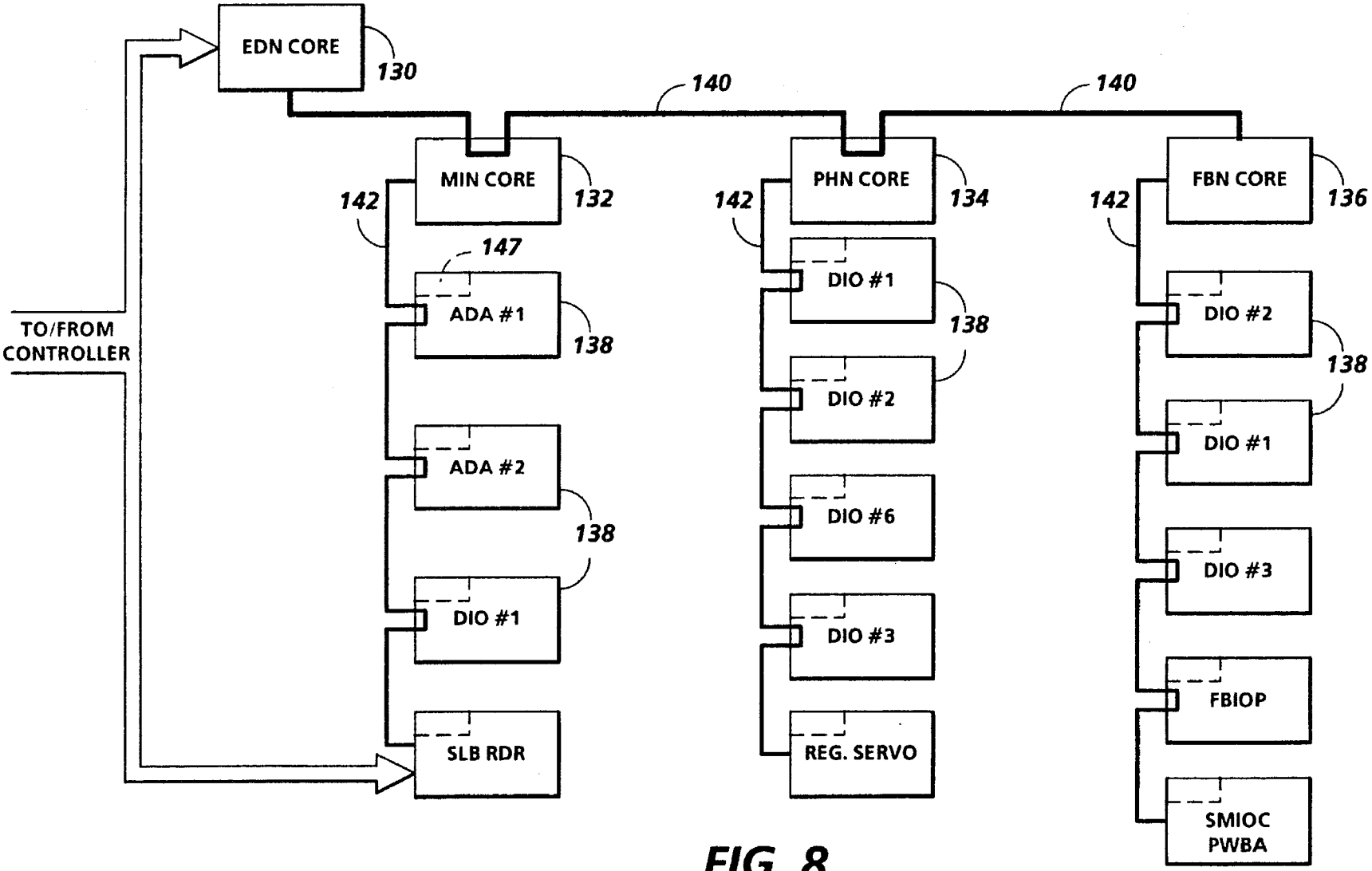
Figure 9:
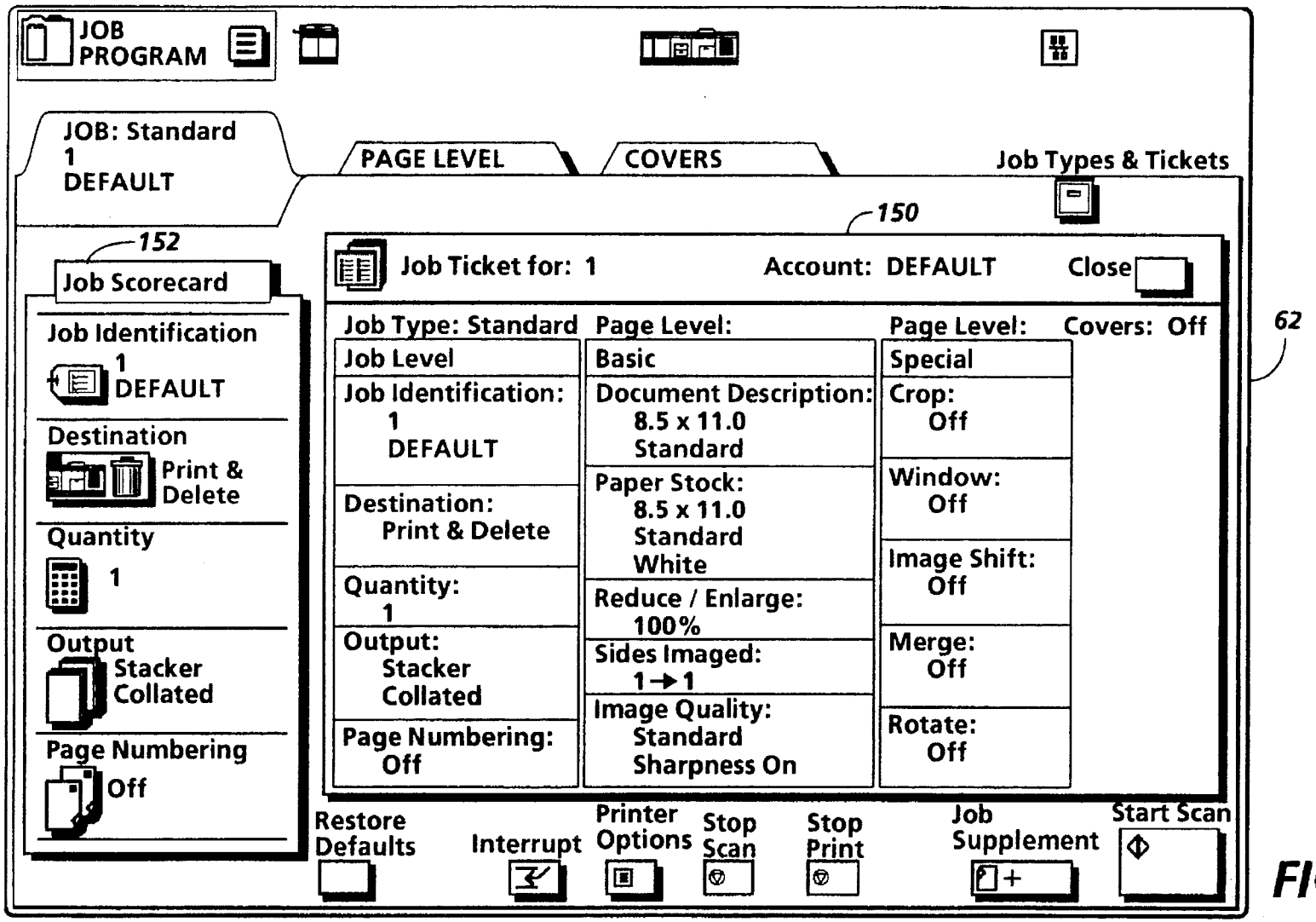
Figure 10:
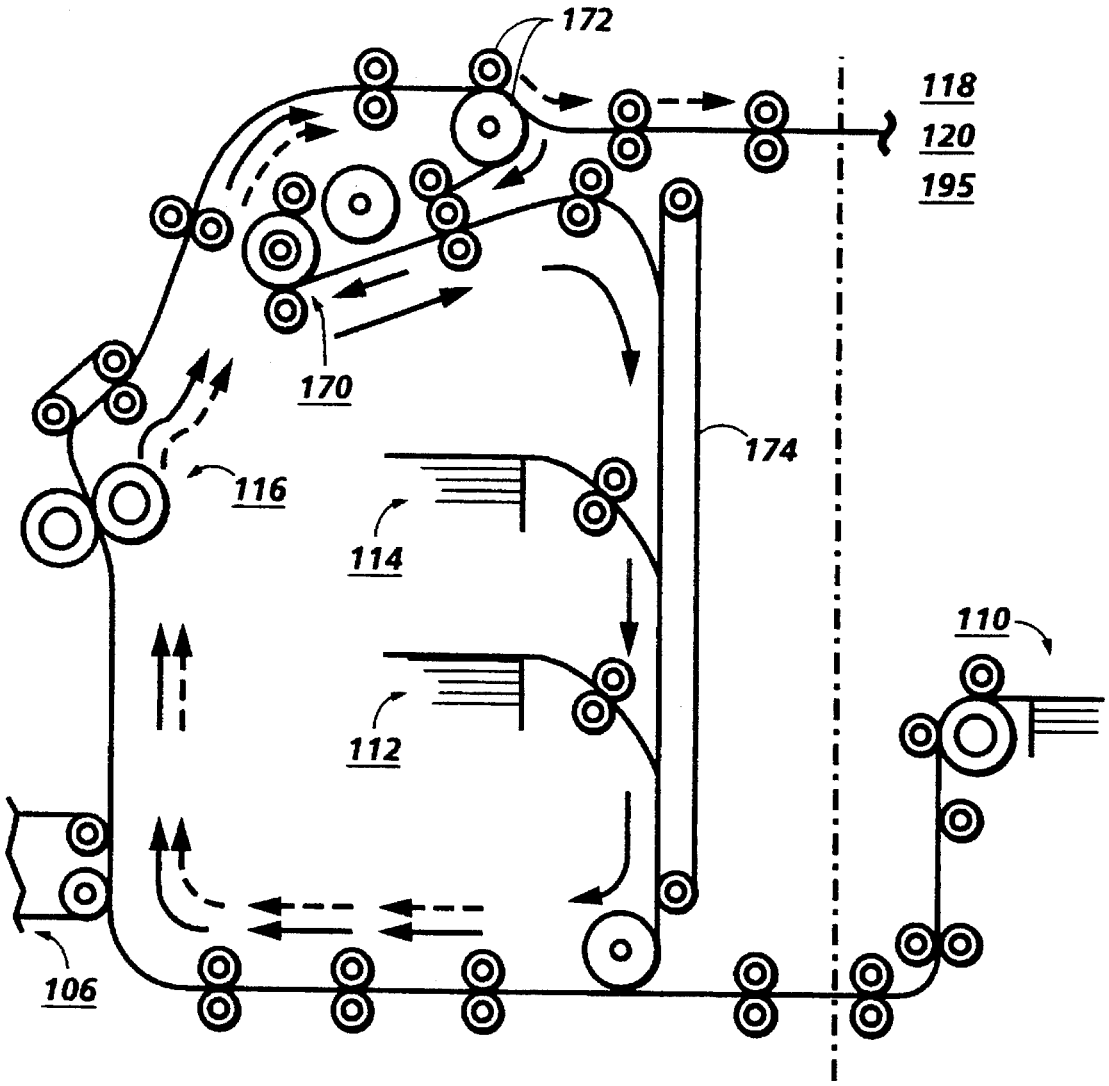
Figure 11:
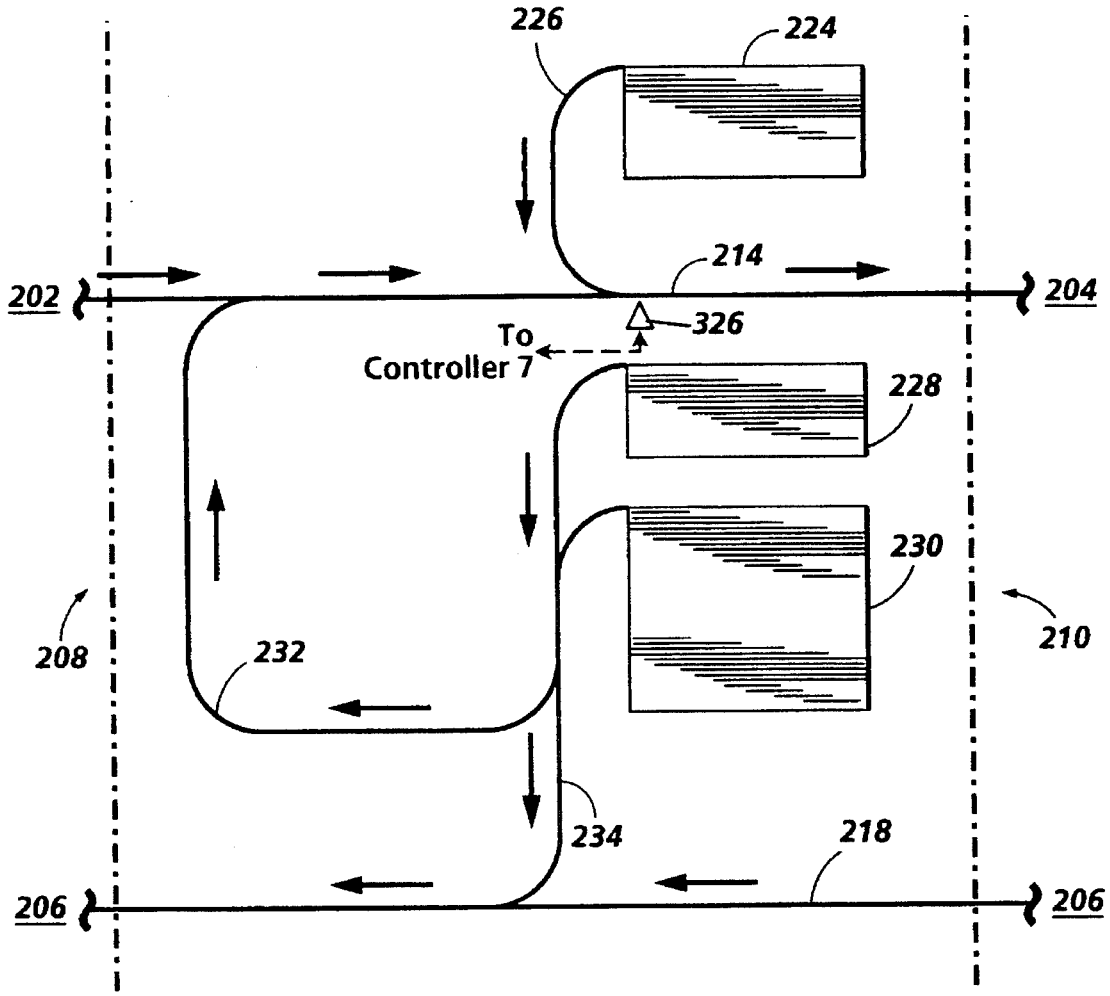
Figure 12:
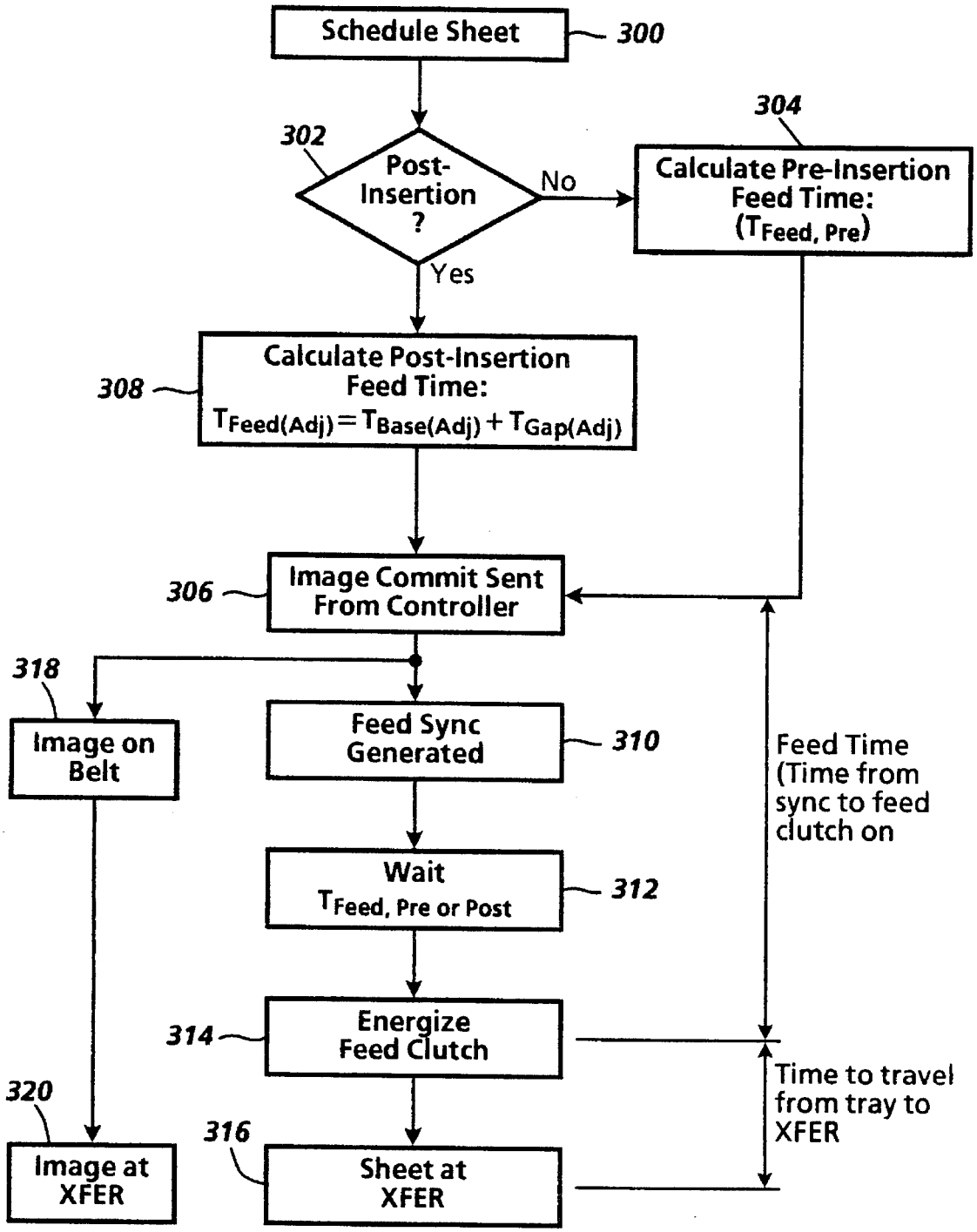
Figure 13:
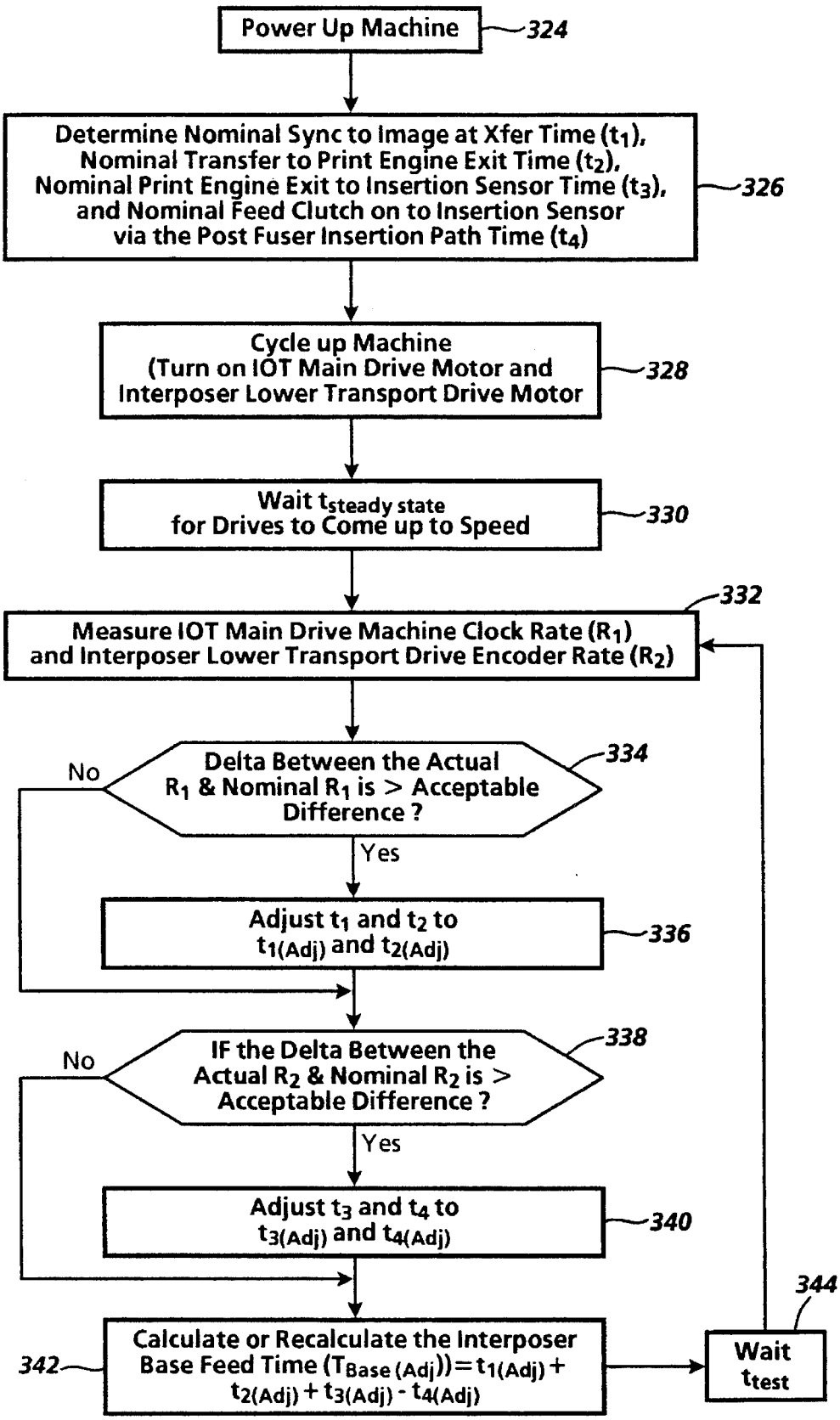
Figure 14:
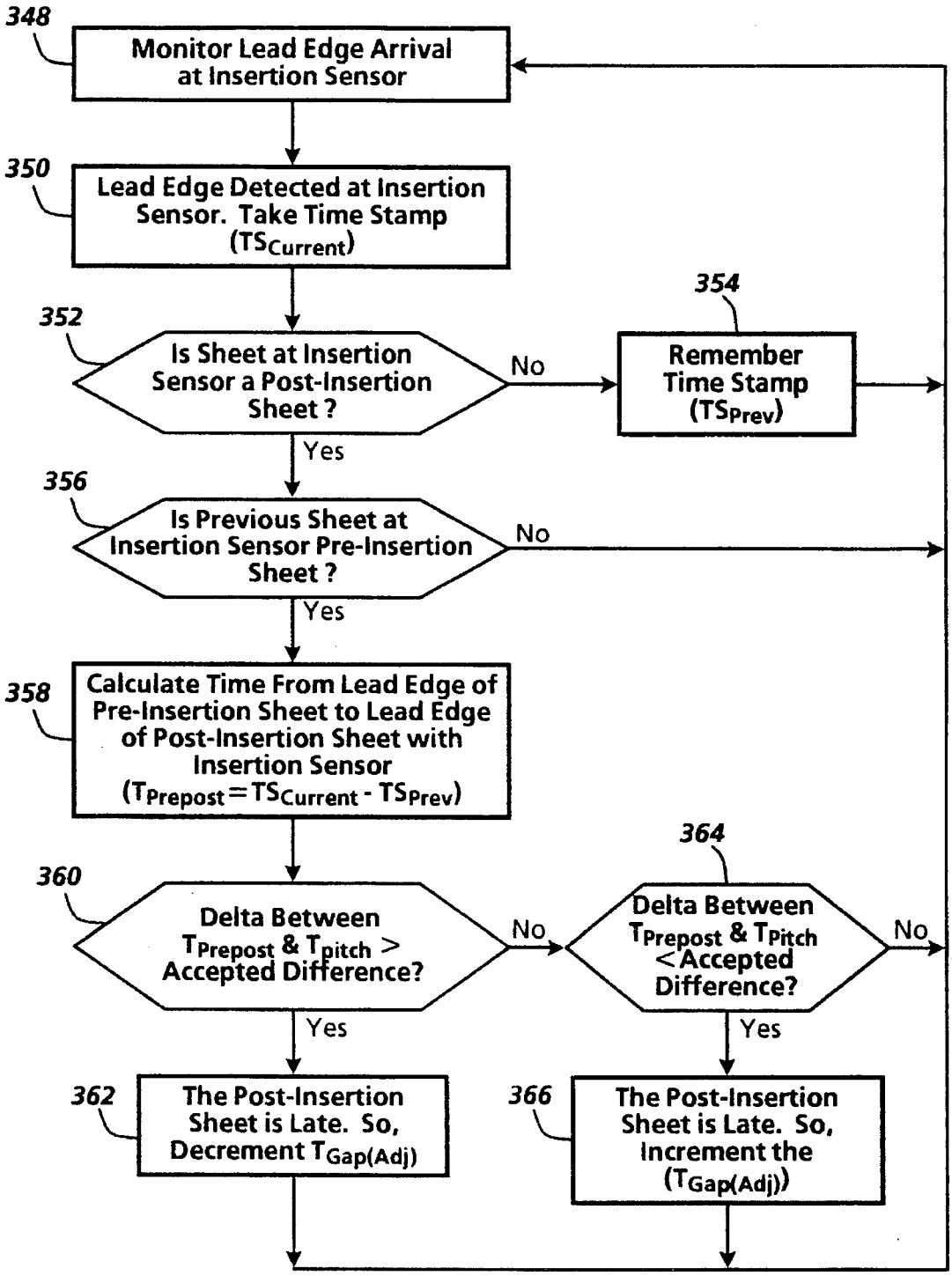

FIGS. 5–7 comprise a schematic block diagram showing the major parts of a control section of the printing system shown in FIG. 1;

FIG. 8 is a block diagram of the Operating System, together with Printed Wiring Boards and shared line connections for the printing system shown in FIG. 1;

FIG. 9 is an elevational view depicting an exemplary job programming ticket and job scorecard displayed on the User Interface(UI) touchscreen of the printing system shown in FIG. 1;

FIG. 10 is an elevational view illustrating simplex and duplex paper paths through which sheets are conveyed through the system of FIG. 3;

FIG. 11 is an elevational view schematically illustrating various mechanical components of an interposing module, the interposing module being operatively coupled with the printing system of FIG. 1;

FIG. 12 is a flow diagram depicting an overview of the special insert sheet feeding technique of a preferred embodiment;

FIG. 13 is a flow diagram depicting a technique for adjusting a base special insert sheet feed time; and FIG. 14 is a flow diagram depicting a technique for further adjusting the base special insert sheet feed time of FIG. 13.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
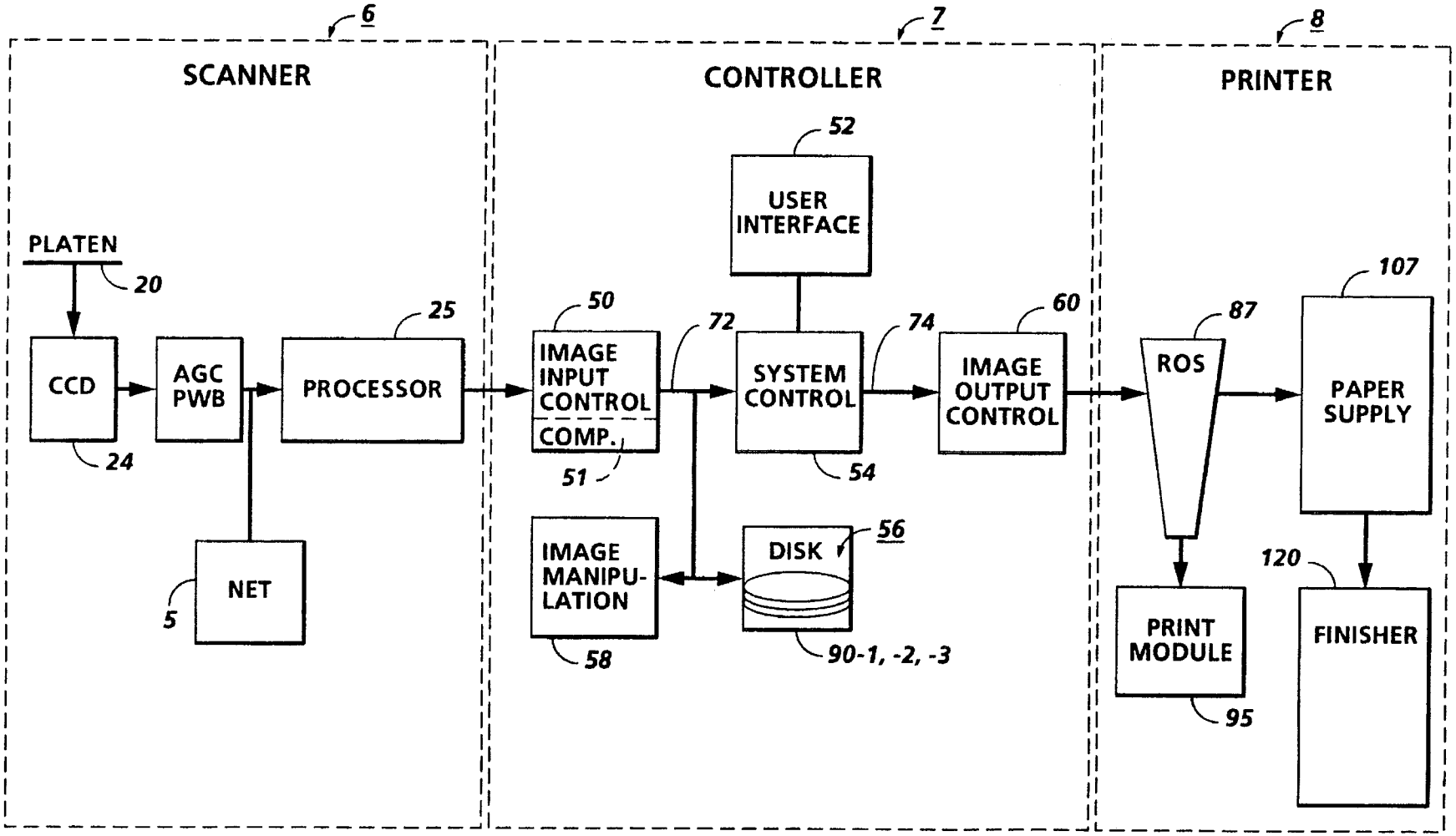
FIG. 2 is a block diagram depicting the major elements of the printing system shown in FIG. 1.

Referring to FIGS. 1 and 2, there is shown an exemplary laser based printing system (or imaging device) 2 for processing print jobs in accordance with the teachings of the present invention. Printing system 2, for purposes of explanation, is divided into a scanner section 6, controller section 7, and printer section 8. While a specific printing system is shown and described, the present invention may be used with other types of printing systems such as ink jet, ionographic, etc.

For off-site image input, image input section 4 has a network 5 with a suitable communication channel, such as an ethernet connection, enabling image data, in the form of image signals or pixels, from one or more remote sources, to be input to system 2 for processing. Other remote sources of image data, such as streaming tape, floppy disk, video camera, etc. may be envisioned.

Figure 4:
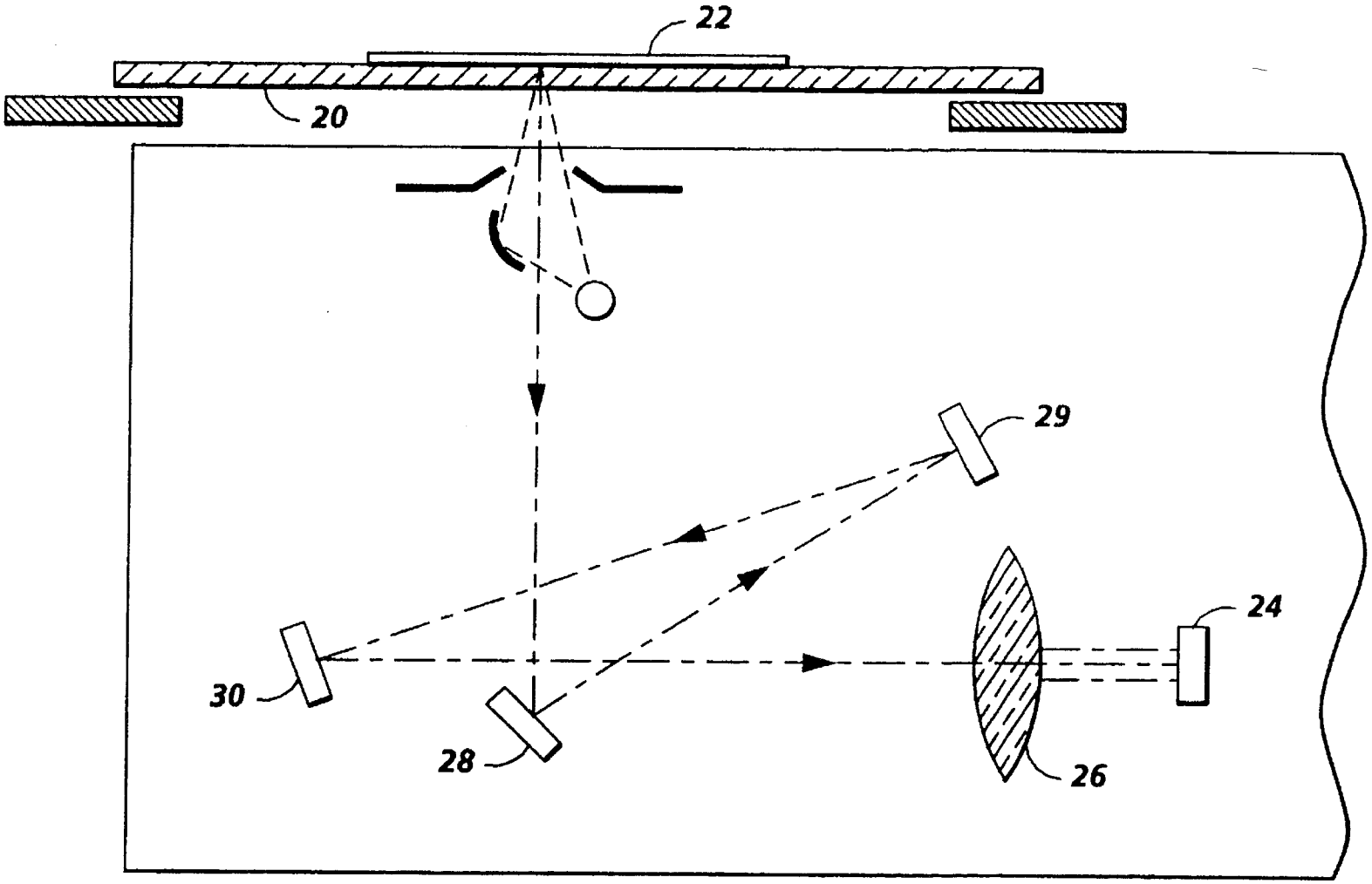
FIG. 4 is a schematic view showing certain construction details of a document scanner of the printing system shown in FIG. 1.

Referring particularly to FIGS. 2–4, scanner section 6 incorporates a transparent platen 20 on which the document 22 to be scanned is located. One or more linear arrays 24 are supported for reciprocating scanning movement below platen 20. Lens 26 and mirrors 28, 29, 30 cooperate to focus array 24 on a line like segment of platen 20 and the document being scanned thereon. Array 24 provides image signals or pixels representative of the image scanned which, after suitable processing by processor 25, are output to controller section 7.

Processor 25 converts the analog image signals output by array 24 to digital image signals and processes the image signals as required to enable system 2 to store and handle the image data in the form required to carry out the job programmed. Processor 25 also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and feed rolls 41 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which, in turn, advances a page of the fanfold material into position on platen 20.

Referring to FIGS. 2 and 3, printer section 8 comprises a laser type printer and, for purposes of explanation, is separated into a Raster Output Scanner (ROS) section 87, Print Module Section 95, Paper Supply Section 107, and High Speed Finisher 120. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112 or 114. The developed image transferred to the print media 108 is permanently fixed or fused by fuser 116 and the resulting prints discharged to either output tray 118, to high speed finisher 120, or through bypass 180 to some other downstream finishing device, which could be a low speed finishing device such as a signature booklet maker (SBM) 195 of the type manufactured by Bourg AB. High speed finisher 120 includes a stitcher 122 for stitching or stapling the prints together to form books and thermal binder 124 for adhesively binding the prints into books.

Referring still to FIG. 3, the SBM 195 is coupled with the printing system 2, by way of a bypass 180, for receiving printed signatures. A sheet rotary 190 is positioned at an input of the SBM and the SBM includes three stations, namely a stitching station, a folding station and a trimming station, in which a plurality of signatures are processed. In operation, the signatures are transported through the bypass 180 to the sheet rotary 190 where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature set are trimmed with a cutting blade. Further details regarding the structure and function of the SBM 195 can be obtained by reference to U.S. Pat. No. 5,159,395 to Farrell et al.

Referring to FIGS. 1, 2 and 5, controller section 7 is, for explanation purposes, divided into an image input controller 50, User Interface(UI) 52, system controller 54, main memory 56, image manipulation section 58, and image output controller 60.

The scanned image data input from processor 25 of scanner section 6 to controller section 7 is compressed by image compressor/processor 51 of image output input controller 50 on PWB 70-3. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information, diagnostic information, etc. Items displayed on touchscreen 62 such as files and icons are actuated by either touching the displayed item on screen 62 with a finger or by using mouse 66 to point a cursor to the item selected and keying the mouse.

Main memory 56 has plural hard disks 90-1, 90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Image data output to image output controller 60 is decompressed and readied for printing by image generating processors 86 of PWBs 70-7, 70-8 (seen in FIG. 5). Following this, the data is output by dispatch processors 88, 89 on PWB 70-9 to printer section 8. Image data sent to printer section 8 for printing is normally purged from memory 56 to make room for new image data.

Referring particularly to FIGS. 5–7, control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs include system processor PWB 70-1 having plural system processors 78; low speed I/O processor PWB 70-2 having UI communication controller 80 for transmitting data to and from UI 52; PWBs 70-3, 70-4, 70-5 having disc drive controller/processors 82 for transmitting data to and from discs 90-1, 90-2, 90-3, respectively, of main memory 56 (image compressor/processor 51 for compressing the image data is on PWB 70-3); image manipulation PWB 70-6 with image manipulation processors of image manipulation section 58; image generation processor PWBs 70-7, 70-8 with image generation processors 86 for processing the image data for printing by printing section 8; dispatch processor PWB 70-9 having dispatch processors 88, 89 for controlling transmission of data to and from printer section 8; and boot control-arbitration-scheduler PWB 70-10.

Referring particularly to FIG. 8, system control signals are distributed via a plurality of printed wiring boards (PWBs). These include EDN (electronic data node) core PWB 130, Marking Imaging core PWB 132, Paper Handling core PWB 134, and Finisher Binder core PWB 136 together with various Input/Output (I/O) PWBs 138. A system bus 140 couples the core PWBs 130, 132, 134, 136 with each other, while local buses 142 serve to couple the I/O PWBs 138 with each other and with their associated core PWB. Additionally, as seen in FIG. 8, the controller section 7 communicates with each of the PWBs.

A Stepper Motor Input Output Controller (SMIOC) Printed Wiring Board Assembly (PWBA) is included when the printing system is used with an SBM. The SMIOC PWBA controls the operation of a sheet rotator which may be required when using the SBM. The SIMIOC PWBA also handles the exporting of control signals from the printer to the SBM and monitors the status lines from the SBM. The SBM has two status lines whose status is either high or low. The status lines respectively indicate whether the SBM is ready and whether the SBM (output stacking tray) is full.

On machine power up, the Operating System software is loaded from memory 56 to EDN core PWB 130 and from there to remaining core PWBs 132, 134, 136 via bus 140, each core PWB 130, 132, 134, 136 having a boot ROM 147 for controlling downloading of Operating System software to PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

Referring to FIG. 9, jobs are programmed in a Job Program mode in which there is displayed on touch-screen 62 a Job Ticket 150 and a Job Scorecard 152 for the job being programmed. Job Ticket 150 displays various job selections programmed while Job Scorecard 152 displays the basic instructions to the system for printing the job.

In one embodiment, the printing system 2 is a DocuTech® Network Printing System ("Network Printer") which prints jobs transmitted from a workstation(not shown) by way of the network connection 5 (FIG. 2). The Network Printer processes network jobs written in a page description language ("PDL") known as "Interpress" and as a prerequisite to printing the network job, the Network Printer decomposes the job from a high level primitive form to a lower level primitive form. The decomposition process is discussed in further detail in U.S. application Ser. No. 07/898,761 entitled "Apparatus and Method for Multi-Stage/Multi-Process Decomposing", filed on Jun. 12, 1992, by Bonk et al., the pertinent portions of which are incorporated herein by reference. In another embodiment the Network Printer is used, in conjunction with a DocuTech® Network Server, to print jobs written in, among other PDLs, Postscript®. The structure and operation of the DocuTech® Network Server may be more fully comprehended by reference to U.S. Pat. No. 5,226,112 to Mensing et al., the pertinent portions of which are incorporated herein by reference. Decomposed jobs are commonly stored, for output, in a job file (not shown) of the Network Printer and later transferred to the print queue for printing. As discussed in further detail below there can be delays associated with printing network jobs.

FIG. 10 is a plan view illustrating the duplex and simplex paper paths through which sheets are conveyed in the system of FIG. 3. In FIG. 10, the path through which a sheet travels during duplex imaging is illustrated by the arrowed solid lines, whereas the path through which a sheet to be simplex imaged travels is illustrated by the arrowed broken lines. After an appropriately sized sheet is supplied from one of feed trays 110, 112 or 114, the sheet is conveyed past image transfer station 106 to receive an image. The sheet then passes through fuser 116 where the image is permanently fixed or fused to the sheet. After passing through rollers 172, gates (not shown) either allow the sheet to move directly to a final destination (e.g., tray 118, high speed finisher 120, SBM 195), or deflects the sheet into single sheet inverter 170. If the sheet is either a simplex sheet or a duplex sheet having completed side one and side two images formed thereon, the sheet will be conveyed directly to its final destination. If the sheet is a duplex sheet printed only with a side one image, the gate will deflect the sheet into inverter 170, where the sheet will be inverted and then fed to belt 174 for recirculation past transfer station 106 and fuser 116 for receiving and permanently fixing the side two image to the backside of the sheet. Examples of single sheet inverters usable with the present invention are disclosed in U.S. Pat. Nos. 4,918,490; 4,935,786; 4,934,681; and 4,453,841, the disclosures of which are herein incorporated by reference.

The control of all machine functions, including all sheet feeding, is, conventionally, by a machine controller. The controller is preferably a known programmable microprocessor system, as exemplified by extensive prior art, e.g., U.S. Pat. No. 4,475,156 and its references. Plural but interconnecting microprocessors, as shown in FIGS. 5–7, may also be used at different locations. The controller conventionally controls all the machine steps and functions described herein, and others, including the operation of the document feeder, all the document and copy sheet deflectors or gates, the sheet feeder drives, the downstream finishing devices 120, 195, etc. As further taught in the references, the controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays, jam correction, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The presently disclosed embodiment indirectly exploits the sheet scheduling techniques of U.S. Pat. Nos. 5,095,342 and 5,159,395. In particular, marking software is employed, in conjunction with one or more controllers, to implement the present sheet scheduling technique. The controllers which control the sheet scheduling described in the present application are Image Output Control 60 and EDN Core 130 of FIGS. 2 and 8, respectively. The majority of the sheet scheduling functions are performed by the EDN Core 130. The Image Output 60 is responsible for converting simplex sheets to duplex with blank back sides. The reason for this difference in responsibility is that the controller 7 needs to know the 'plex of all sheets to prepare the images correctly. Of course, other controller structures are possible depending on the hardware and software used to implement the present embodiment.

The functionality of the marking software is discussed, in some detail, in U.S. patent application Ser. No. 08/010,104, to Hammer et al., entitled "Apparatus and Method for Managing Memory in a Printing System" and filed Jan. 28, 1993, the pertinent portions of which are incorporated herein by reference. As discussed in the '104 Application, with the marking software, the time at which each stored image is to be fed to the photoreceptor 98 (FIG. 3) is designated in a list or table, in advance of marking. As printing proceeds, the scheduling controller refers to the list or table for determining which image should be fetched from disk (FIG. 2), and transmitted to the system memory 61 (FIG. 5), for processing by one of the image generator processors 86. During the scheduling process the scheduling controller may generate gaps (defined by one or more unused pitches) between a set or a job. Moreover, pitches may be intentionally scheduled within the printing of a single set. For example, as discussed in U.S. Pat. No. 5,159,395, in one mode of operation it is preferable to interleaf a pitch between two adjacent sheets on the photoreceptor to facilitate the finishing of multiple sets produced from a stored job.

Referring to FIG. 11, an interposing module (also referred to below as simply "interposer") is designated by the numeral 200. Reference is made to FIG. 3 for understanding the employment of the interposer in the printing system 10. In particular, imaged substrate exit the print engine at output nip 202 and enter the finisher 120 by way of an inverting station 204. Additionally, sheets can be fed to the print engine from the high capacity feeder 110, by way of a pair of nips 206. Referring conjunctively to FIGS. 3 and 11, in the preferred embodiment, a print engine side 208 of the interposer is operatively coupled with both the nip 202 and another one of the nips 206 while a finishing side 210 of the interposer is operatively coupled with both the inverting station 204 and one of the nips 206. Further details regarding the coupling of the interposer 200 with the print engine and the finisher will appear below.

Referring still to FIG. 11, the interposer 200 includes a first sheet transport path 214 and second sheet transport path 218. The first sheet transport path communicates with the exit of the print engine and the entrance of the finisher while the second sheet transport path communicates with the high capacity feeder 110 and a sheet feed path 222 of the print engine. In one example, a first sheet tray 224 communicates with the first sheet transport path 214, by way of a first feed path 226, while each of a second sheet tray 228 and a third sheet tray 230 communicate with the first sheet transport path by way of a second feed path 232. Additionally, each of the sheet trays 228, 230 communicate with the second sheet transport path 218 by way of a third feed path 234. In another embodiment, sheet trays 228, 230 are combined structurally to provide high capacity sheet feeding functionality.

As should be appreciated, the interposer is a flexible module which provides a variety of operational modes. In a first mode of operation, the interposer serves as a supplementary feeder for the print engine. More particularly, through use of the third feed path 234 and the second sheet transport path 218 sheets are fed to the print engine from either of sheet trays 228, 230. In a second mode of operation, sheets are added to a stream of imaged substrates exiting the print engine at nip 202. For many cases, operation in the second mode will include adding a "special insert" sheet, e.g. cover, separator, preprinted or drilled sheet, to the stream of imaged substrates. In a first submode of the second mode of operation, a special insert sheet is added to either the beginning or end of a selected stream. In a second submode of the second mode of operation a special insert sheet is interposed between a leading imaged substrate and a trailing imaged substrate of the same job. In one implementation of the second submode, control signals are scheduled in such a way that a leading imaged substrate, a special insertion sheet and a trailing imaged substrate are scheduled respectively to be fed in a first pitch, a second pitch and a third pitch.

Referring to FIGS. 3, 11 and 12 an overview of a special insert sheet feed algorithm is discussed. In one example of operation, the sheets of a given job, which may include include a set of pre-insertion sheets (substrates from tray 110, 112, 114, 228 and/or 230) and a set of post-insertion sheets (special sheets from tray 224, 228 or 230) are scheduled with the controller 7 at step 300. Pursuant to the scheduling process, the controller determines, at step 302, whether the sheet to be scheduled is a pre-insertion sheet (i.e. an imageable substrate) or a post-insertion sheet (i.e. a special insert sheet to be interposed into a stream of imaged regular substrates). If the sheet being scheduled is a pre-insertion sheet, then, per step 304, the time period required to wait after a given sync signal, namely $T_{Feed,\ Pre}$, is calculated for that sheet. Referring to FIGS. 8 and 12, subsequent to the calculation of step 304, an image commit signal is transmitted by the EDN core 130 to the various system nodes, via step 306, provided it is determined that the image corresponding with the pre-insertion sheet can be transmitted from memory (e.g. disk) to the print engine (FIGS. 5–7) within a predefined time period (e.g. a predefined number of pitches).

If the sheet is a special insert sheet to be interposed in a stream of imaged regular substrates, then the calculation of step 308 to determine $T_{Feed\ (Adj)}(=T_{Base\ (Adj)}+T_{Gap\ (Adj)})$ is performed and an image commit signal is transmitted to the various system nodes (FIG. 8). A detailed discussion of step 308, i.e the calculation of $T_{Feed\ (Adj)}$, will be provided below. At step 310, the MIN core designates a sync signal for the current sheet being scheduled. As is known by those skilled in the art, a printing system, such as the Xerox' DocuTech® printing system, generates sync signals at regular intervals and employs those signals as references to determine the point in time at which, among other things, a sheet should be fed from a selected paper tray. Subsequent to designating a sync signal for a selected sheet, the controller waits a time period equal to $T_{Feed,Pre}$ or $T_{Feed(Adj)}$ (step 312) and then energizes a feed clutch (step 314) to initiate the feeding of the selected sheet. In response to energizing the feed clutch, either a pre-insertion sheet is imaged and transmitted onto the interposer 200 or a post-insertion sheet is, at least in one example, interposed into a stream of imaged substrates (step 316). Referring still to FIG. 12, it will be recognized that concurrent with steps 312, 314 and 316, a latent image is formed on both the photoreceptor 98 (FIG. 3) and developed (step 318) for transfer at step 320.

Referring to step 308 of FIG. 12 and FIG. 13, the calculation of $T_{Base(Adj)}$ is explained in detail. When the printing system 2 is powered up (step 324) various values associated with transporting sheets in both the printer 8 (FIG. 3) and the interposer 200 are, via step 326, determined. As should be recognized from FIGS. 12 and 13, $t_1$ and $t_2$ are associated with the print engine. In particular, $t_1$ is associated with a time period required to move a given substrate from one of the feed trays 110, 112, 114, 228 or 230 (FIGS. 3 and 11) to a location at the photoreceptor at which the substrate is to be imaged, while $t_2$ is associated with a time period required to move the given substrate from the location at the photoreceptor to the print engine side 208 (FIG. 11). On the other hand, $t_3$ and $t_4$ are associated with the interposer 200. That is, $t_3$ is associated with a time period required to move the given substrate from the print engine side 208 to an insertion sensor 326 [MAKE SURE THIS GETS INTO FIG. 11] while $t_4$ is associated with a time period required to move a special insert sheet from one of the trays 224, 228, 230 to the insertion sensor 236 (e.g. a photosensitive type sensor). It will be noted that the insertion sensor 326 communicates with the controller 7 (FIGS. 2, 5–7) for providing information about sheet/substrate location within the interposer 200.

In practice, the values for $t_1$, $t_2$, $t_3$ and $t_4$ are hardcoded at the EDN 130 of FIG. 8. It will be appreciated that these values can be calculated readily by reference to measured paper path lengths for both the printer 8 and interposer 200 as well as the theoretical machine clock rate of the printer (theoretical or nominal $R_1$) and the theoretical machine clock rate of the interposer (theoretical or nominal $R_2$). As is known, under ideal circumstances, the paper path roller speeds in both the printer and interposer vary directly as a function of their respective theoretical printer and interposer machine clock rates.

Referring again to FIG. 13, the printer (also referred to herein as "image output terminal (IOT)") and interposer are cycled up, at step 328 and the controller 7 (FIG. 2) is made to wait $t_{Steady\ State}$ (about 2000 ms in one embodiment) (step 330) before measuring, at step 332, the actual machine clock rate of the printer ($R_1$) and the machine clock rate of the interposer ($R_2$). In turn, the delta (e.g. difference or ratio) between actual $R_1$ and theoretical or nominal $R_1$ is, at step 334, compared with an acceptable reference (e.g. difference or ratio). If the delta is greater than the acceptable reference, then $t_1$ and $t_2$ are adjusted, via step 336, to bring those values into accordance with the actual machine clock rate of the printer. In one example each of $t_1$ and $t_2$ are multiplied by the ratio of $R_{1(Actual)}/R_{1(Theoretical)}$ to obtain $t_{1(Adj)}$ and $t_{2(Adj)}$.

Next, the delta between actual $R_2$ and theoretical or nominal $R_2$ is, at step 338, compared with an acceptable reference. If the delta is greater than the acceptable reference, then $t_3$ and $t_4$ are adjusted, via step 340, to bring those values into accordance with the actual machine clock rate of the interposer. In one example, each of $t_3$ and $t_4$ are multiplied by the ratio of $R_{2(Actual)}/R_{2(Theoretical)}$ to obtain $t_{3(Adj)}$ and $t_{4(Adj)}$. To obtain $T_{Base(Adj)}$, all of $t_{1(Adj)}$, $t_{2(Adj)}$, $t_{3(Adj)}$ and $t_{4(Adj)}$ are summed, at step 342 and after a waiting period of $t_{Test}$ (step 344) (about 1000 ms in one embodiment), the steps 332, 334, 336, 338, 340 and 342 are repeated to insure that the value of $T_{Base}$ tracks the actual, rather than the theoretical or nominal, machine clock rate.

Referring to FIGS. 11, 12 (step 308) and 14, a further approach to adjusting $T_{Feed}$, in which $T_{Gap(Adj)}$ is calculated, is discussed. At step 348, a lead edge is detected at insertion sensor 326 and, at step 350, a time stamp ($TS_{Current}$) is generated with controller 7. In accordance with information available at the EDN (FIG. 8), it can be determined, at step 352, whether the sheet at the sensor is an imaged substrate (pre-insertion sheet) or a special insert sheet from an interposer tray (post-insertion sheet). If the sheet is an imaged substrate, then a corresponding time stamp ($TS_{Prev}$), indicating the time at which the lead edge of the imaged substrate passed by the sensor, is generated at step 354 and the process loops back to step 348. If the sheet is a special insert sheet, then it is determined, at step 356, whether the previous sheet, at the insertion sensor, was an imaged substrate. If the previous sheet is not an imaged substrate, then the process loops back to step 348, otherwise the process proceeds to step 358 where the time corresponding to the distance from the lead edge of the imaged substrate to the lead edge of the special insert sheet ($T_{Prepost}$) is calculated.

Ideally, the distance between the lead edge of an imaged substrate and the lead edge of a special insert sheet should be no greater than a predefined pitch. Accordingly, a check is performed at step 360 to determine if difference between $T_{Prepost}$ and $T_{Pitch}$ (i.e. the time required to move a sheet a single pitch in the interposer) is greater than an accepted difference. As will be appreciated, by reference to FIG. 12, a special insert sheet is delivered to the path 214 (FIG. 11) after a predetermined feed time has elapsed. The controller 7, in one example, keeps track of this period by reference to a counter. As shown in FIG. 13, at step 362, when the difference between $T_{Prepost}$ and $T_{Pitch}$ is greater than the accepted difference, then the count of the counter is adjusted downward by a preselected amount. On the other hand, when it is determined, via step 364 that the difference between $T_{Prepost}$ and $T_{Pitch}$ is less than the accepted difference then the counter is adjusted upward (step 366) by a preselected amount.

Numerous features of the disclosed embodiment will be appreciated by those skilled in the art:

First, a technique of estimating a feed time for an interposing module of the type used with a print engine is provided. In such technique various time periods associated with interposing a special insert sheet with a stream of imaged regular substrate are set. With these set times it is possible to determine the point in time at which the special insert sheet should be fed from a special insert sheet tray so that the special insert sheet is properly positioned relative to at least one of the imaged regular substrates.

Second, the present technique accommodates for changes in machine clock rate of the print engine and/or the interposing module. By comparing the theoretical or nominal machine clock rates of the print engine and interposing module to respective actual machine clock rates, it is possible to adjust the point in time at which the special sheet is fed from its corresponding special insert tray. This insures that the special sheet will not overlap with any of the imaged regular substrates.

Finally, the present technique accommodates for the effect of component degradation in both the print engine and the interposing module. More particularly, as, for instance, rollers wear, the rate at which imaged regular substrates are delivered to the interposing module changes. To compensate for changes the gap between one of the imaged regular substrates and an adjacent special insert sheet is gaged. If the magnitude of the gap becomes greater or lesser than an acceptable tolerance, then feed times are adjusted accordingly. In one example, this is accomplished by adjusting a counter which counts down (or up) to a given point in time at which the special insert sheet is to be fed from the special insert sheet tray.

What is claimed is:

1. In a printing system for producing a print job, the printing system including a print engine for imaging regular substrates, fed to the print engine from a regular substrate feeding apparatus, and delivering the imaged regular substrates as an output, an interposer and control apparatus comprising:

a) a special sheet insertion system operatively coupled with said print engine, said special sheet insertion system including, i) special sheet insertion subsystem for holding and feeding special insert sheets, ii) a special sheet insertion path passing by said special sheet insertion subsystem, the special insert sheets being feedable to the special sheet insertion path and interposed into the delivered output of imaged regular substrates;

b) a processor, communicating with the print engine and said special insert sheet insertion system, said processor, i) setting a first set of one or more time periods associated with moving one of the imaged regular substrates from a source point associated with the print engine to a point adjacent the special sheet insertion system, ii) setting a second set of time periods associated with moving both the one of the imaged regular substrates and one of the special insert sheets in said special sheet insertion system, and iii) determining a point in time at which the one of the special insert sheets is to be fed from said special sheet insertion subsystem to said special sheet insertion path by reference to the first and second sets; and c) said special sheet insertion subsystem feeding the one of the special insert sheets to said special sheet insertion path at a point in time in accordance with said determined point in time.

2. The interposer and control apparatus of claim 1, in which sync signals are generated for operation of the print engine, one of the sync signals is designated as a feed signal and one of the regular substrates is imaged in response to the generation of the one sync signal, wherein said b) i)includes:

setting a first time period occurring between designating the sync signal and imaging the one regular substrate; and setting a second time period occurring between imaging the one regular substrate and delivering it as an output to said special sheet insertion path.

3. The interposer and control apparatus of claim 2, in which the print engine includes a theoretical machine clock rate and an actual machine clock rate, wherein:

the actual machine clock rate is compared with the theoretical machine clock rate; and one or both of the first and second time periods are adjusted as a function of the comparison between the actual machine clock rate and the theoretical machine clock rate.

4. The interposer and control apparatus of claim 1, in which both the one imaged regular substrate and the one special insert sheet pass by a sensing device, wherein said b) ii) includes:

setting a first time period defined by a point in time at which the imaged regular substrate exits the print engine and a point in time at which the imaged regular substrate passes by the sensing device; and setting a second time period defined by a point at which the special insert sheet is fed from said special sheet insertion subsystem and a point in time at which the one special insert sheet passes by the sensing device.

5. The interposer and control apparatus of claim 4, in which the special sheet insertion system includes a theoretical machine clock rate and an actual machine clock rate, wherein:

the actual machine clock rate is compared with the theoretical machine clock rate; and one or both of the first and second time periods are adjusted as a function of the comparison between the actual machine clock rate and the theoretical machine clock rate.

6. The interposer and control apparatus of claim 1 wherein said special sheet insertion system further comprises a sensing device, disposed adjacent said special sheet insertion path, for sensing when one of the imaged regular substrates or the special insert sheets passes thereby, said sensing device communicating with said processor for transmitting a signal thereto when a leading or lagging edge of the one of the imaged regular substrates or the special insert sheets is sensed by said sensing device, said time periods of the second set being set by reference to the signal received at said processor.

7. In a printing system for producing a print job, the printing system including a print engine for imaging regular substrates, fed to the print engine from a regular substrate feeding apparatus, and delivering the imaged regular substrates as an output, the delivered output including a series of spaces, an interposer and control apparatus comprising:

a) a special sheet insertion system operatively coupled with said print engine, said special insert sheet insertion system including, i) a special sheet insertion subsystem for holding and feeding special insert sheets, the special insert sheets including a first special insert sheet and a second special insert sheet, the first special insert sheet being scheduled to be fed from said special insertion subsystem at a first scheduled point in time and the second special insert sheet being scheduled to be fed from said special insertion subsystem at a second scheduled point in time, ii) a special sheet insertion path passing by said special sheet insertion subsystem, the special insert sheets being feedable to the special sheet insertion path and interposable with the delivered output of imaged regular substrates;

b) said special sheet insertion subsystem feeding the first special insert sheet to the special sheet insertion path, at the first scheduled point in time, so that the first special insert sheet is disposed in one of the series of spaces to form a gap between one of the imaged regular substrates and the first special insert sheet, the gap having a magnitude associated therewith;

c) a controller for determining whether the magnitude associated with the gap is within of a predefined tolerance; and d) when the magnitude associated with the gap is outside of the predefined tolerance, said controller rescheduling the second scheduled point in time.

8. The interposer and control apparatus of claim 7, wherein said special sheet insertion system further comprises a sensing device, disposed adjacent said special sheet insertion path, for sensing when one of the imaged regular substrates or the special insert sheets passes thereby, said sensing device communicating with said controller for transmitting a signal thereto when a leading or lagging edge of the one imaged regular substrate or special insert sheet is sensed by said sensing device.

9. The interposer and control apparatus of claim 8, in which, one of the imaged regular substrates and the first special insert sheet pass by said sensing device as a pair with the one imaged regular substrate leading the first special insert sheet, said sensing device senses a leading edge of the one imaged substrate and then a leading edge of the first special insert sheet, and a first time stamp is generated with said controller as the leading edge of the one imaged regular substrate passes by said sensing device and a second time stamp is generated with said controller as the leading edge of the first special insert sheet passes by said sensing device, wherein said controller determines if the magnitude associated with the gap is outside of the predefined tolerance by subtracting the first time stamp from the second time stamp and comparing a resulting difference with a reference time period.

10. The interposer and control apparatus of claim 7, in which said controller includes a counter and the second scheduled point in time is rescheduled by adjusting said counter.

11. In a printing system for producing a print job, the printing system including a print engine for imaging regular substrates, fed to the print engine from a regular substrate feeding apparatus, and delivering the imaged regular substrates as output, the print engine being operatively coupled with a special sheet insertion system, the special sheet insertion system including a special sheet insertion subsystem and a special sheet insertion path passing by the special sheet insertion subsystem, the special sheet insertion subsystem being adapted to hold and feed special insert sheets to the special sheet insertion path for interposing one or more special insert sheets into the delivered output of imaged regular substrates, a method of feeding one of the special insert sheets to the special sheet insertion path at a selected point in time comprising:

a) setting a first set of one or more time periods associated with moving one of the imaged regular substrates from a source point associated with the print engine to a point adjacent the special sheet insertion system;

b) setting a second set of time periods associated with moving both the one of the imaged regular substrates and one of the special insert sheets in said special sheet insertion system;

c) determining a point in time at which the one of the special insert sheets is to be fed from said special sheet insertion subsystem to said special sheet insertion path by reference to the first and second sets; and d) feeding the one of the special insert sheets to said special sheet insertion path at a point in time determined in accordance with said determining.

12. The method of claim 11, in which sync signals are generated for operation of the print engine, one of the sync signals is designated as a feed signal and one of the regular substrates is imaged in response to the generation of the one sync signal, wherein said a) includes:

setting a first time period occurring between designating the sync signal and imaging the one regular substrate; and setting a second time period occurring between imaging the one regular substrate and delivering it as an output to said special sheet insertion path.

13. The method of claim 12, in which the print engine includes a theoretical machine clock rate and an actual machine clock rate, further comprising:

e) comparing the actual machine clock with the theoretical machine clock rate; and f) adjusting one or both of the first and second time periods as a function of said e).

14. The method of claim 11, in which both the one imaged regular substrate and the one special insert sheet pass by the sensing device, wherein said b) includes:

setting a first time period defined by a point in time at which the imaged regular substrate exits the print engine and a point in time at which the imaged regular substrate passes by said sensing device; and setting a second time period defined by a point at which the special insert sheet is fed from said special sheet insertion subsystem and a point in time at which the one special insert sheet passes by the sensing device.

15. The method of claim 14, in which the special sheet insertion system includes a theoretical machine clock rate and an actual machine clock rate, further comprising:

e) comparing the actual machine clock rate with the theoretical machine clock rate; and f) adjusting one or both of the first and second time periods as a function of said e).

16. The method of claim 11, further comprising:

sensing when one of the imaged regular substrates and the one special insert sheet pass by a predesignated point in the special sheet insertion system;

transmitting signals to a processor when leading or lagging edges of the one imaged regular substrate and the one special insert sheet have been sensed at the predesignated point; and setting the time periods of the second set with the signals received at the processor.

17. In a printing system for producing a print job, the printing system including a print engine for imaging regular substrates, fed to the print engine from a regular substrate feeding apparatus, and delivering the imaged regular substrates as an output, the print engine being operatively coupled with a special sheet insertion subsystem, a special sheet insertion path passing by the special sheet insertion subsystem, the special sheet insertion subsystem being adapted to hold and feed special insert sheets into the special sheet insertion path so that one or more special insert sheets are interpossible with the delivered output of imaged regular substrates, a series of spaces being formed in the delivered output of imaged substrates for receiving first and second special insert sheets from the special sheet insertion subsystem when the first special insert sheet is fed from the special sheet insertion subsystem at a first scheduled point in time and the second special insert sheet is fed from the special sheet insertion subsystem at a second scheduled point in time, a method of controlling the feeding of the first and second special insert sheets comprising:

a) feeding the first special insert sheet from the special sheet insertion subsystem to the special sheet insertion path, at the first scheduled point in time, so that the first special insert sheet is disposed in a first one of the series of spaces to form a gap between one of the imaged regular substrates and the first special insert sheet, the gap having a magnitude associated therewith;

b) determining whether the magnitude associated with the gap is within a predefined tolerance; and c) when the magnitude associated with the gap is outside of the predefined tolerance, rescheduling the second scheduled point in time.

18. The method of claim 17, in which one of the imaged regular substrates and the first special insert sheet passes by a sensing device as a pair with the one imaged regular substrate leading the first special insert sheet, further comprising:

sensing a leading edge of the one imaged substrate and then a leading edge of the first special insert sheet;

in response to said sensing of the leading edge of the one imaged substrate and the leading edge of the first special insert sheet, generating a first time stamp corresponding with the leading edge of the one imaged regular substrate passing by a predesignated point and a second time stamp corresponding with the leading edge of the first special insert sheet passing by the predesignated point; and said determining including subtracting the first time stamp from the second time stamp and comparing a resulting difference with a reference time period.

19. The method of claim 17, wherein said c) includes adjusting a counter to reschedule the second scheduled point in time.

* * * * *